United States Patent [19]

Vinci

[11] 3,955,900

[45] May 11, 1976

[54] MOUNTING STRUCTURE

[76] Inventor: J. Fredrick Vinci, 141 Woodland Drive, Forest City, Iowa 50436

[22] Filed: Mar. 17, 1975

[21] Appl. No.: 558,905

[52] U.S. Cl. ..... 417/361; 417/415; 248/21

[51] Int. Cl. ..... F04b 17/00

[58] Field of Search ..... 248/15, 18, 19, 20, 248/21; 417/361, 363, 415

[56] References Cited

UNITED STATES PATENTS

| | | | |
|---|---|---|---|
| 1,491,736 | 4/1924 | Polk | 417/363 |
| 1,842,198 | 1/1932 | Price | 248/18 |
| 2,014,581 | 9/1935 | Norton | 248/18 |
| 2,030,349 | 2/1936 | Bradley | 248/18 |
| 2,772,047 | 11/1956 | Sonnberger | 417/363 |
| 2,899,124 | 8/1959 | Chavsson | 417/363 |
| 3,367,609 | 2/1968 | Latter | 248/18 |
| 3,385,542 | 5/1968 | Enemark et al. | 248/20 |
| 3,545,706 | 12/1970 | Harshman | 248/15 |
| 3,790,308 | 2/1974 | Romer et al. | 417/363 |

FOREIGN PATENTS OR APPLICATIONS

| | | | |
|---|---|---|---|
| 174,384 | 9/1952 | Germany | 417/363 |

*Primary Examiner*—Roy D. Frazier
*Assistant Examiner*—Robert A. Hafer
*Attorney, Agent, or Firm*—Burd, Braddock & Bartz

[57] ABSTRACT

An air compressor supported on a mount with a plurality of tension coil springs. The mount has a base plate secured to a floor panel. Upwardly directed yieldable arms secured to spaced parts of the base plate carry the tension coil springs. The springs are connected to the compressor to yieldably hold the compressor above the base plate.

19 Claims, 8 Drawing Figures

MOUNTING STRUCTURE

BACKGROUND OF INVENTION

Air compressors and like fluid pumping machines use reciprocating pistons to place the fluid under pressure. The moving pistons produce noise and vibrations that are transmitted to the surrounding environment. Limited vibration and noise control has been achieved by mounting pumps and their drive motors on a common base and resiliently mounting the base on a machine or support. An example of this type of structure to mount an electric motor is shown by Clark in U.S. Pat. No. 1,089,748. Other examples are disclosed by Ljungstrom in U.S. Pat. No. 1,066,209 and Rosenzweig in U.S. Pat. No. 2,359,941.

In some motor vehicles, as buses and motor homes, equipment including air compressors, electric generators and water pumps are located in enclosed compartments or box structures. When this equipment is secured directly to the floor or walls of the compartment, it produces vibrations and noise when operated. The vibrations and noise levels are enhanced because the floor or walls of the compartment function as a sounding board.

SUMMARY OF INVENTION

The invention relates to a resilient suspension system for isolating vibration equipment to abate objectional vibrations and noise. More particularly, the invention is directed to a pump or air compressor mounting structure which resiliently supports the pump and the drive motor for the pump to control noise and vibrations. The mounting structure includes a base plate adapted to be fixed to a support. A pair of side arms and an end arm project upwardly from the plate. Coil tension springs are connected to the upper or free ends of the arms and the pump and motor. The springs are more resilient than the arms so that the entire spring-arm suspension system effectively dampens the vibrations and noise established by the pump and drive motor.

An object of the invention is to provide a resilient suspension system for an air pump or compressor that isolates the pump's vibrations and minimizes the noise of the pump. A further object of the invention is to provide compact and low cost mounting structure for equipment that vibrates in use that is relatively simple in construction, reliable in use, and has a minimum number of parts. A further object of the invention is to provide a mounting structure that can resiliently support several types of operating equipment.

IN THE DRAWINGS

FIG. 8 is an end elevational view of the left end of FIG. 3.

DESCRIPTION OF PREFERRED EMBODIMENT

Figure 1:
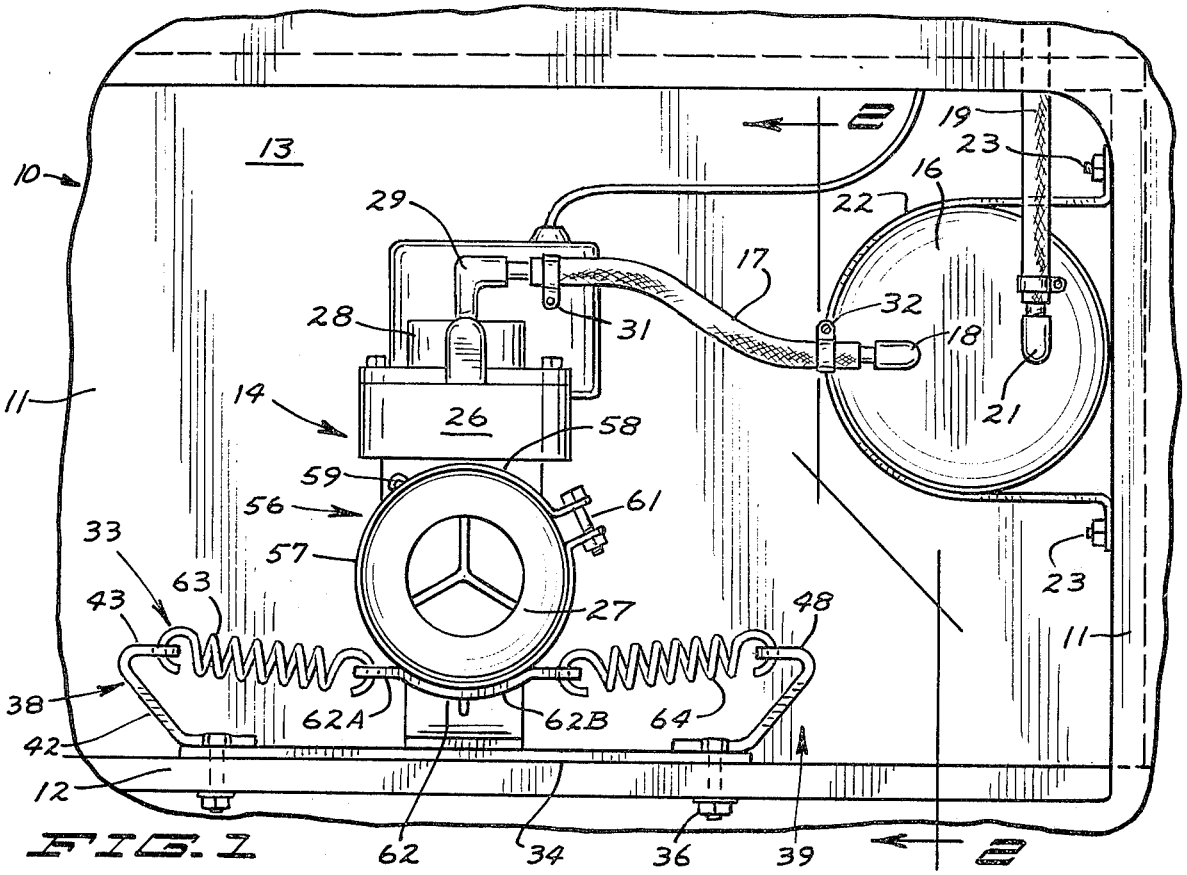
FIG. 1 is a front elevational view of an air compressor located in a compartment of a structure supported by the mount assembly of the invention.
Figure 2:
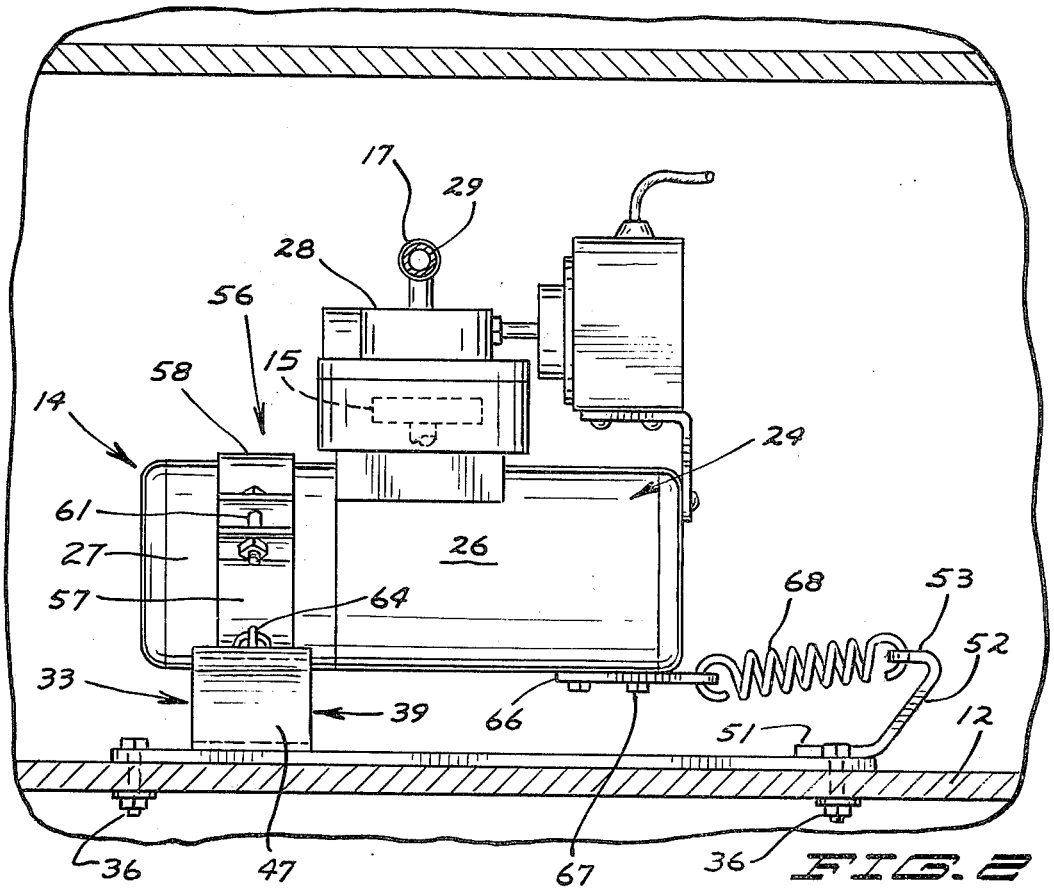
FIG. 2 is a sectional view taken along the line 2—2 of FIG. 1.
Figure 4:
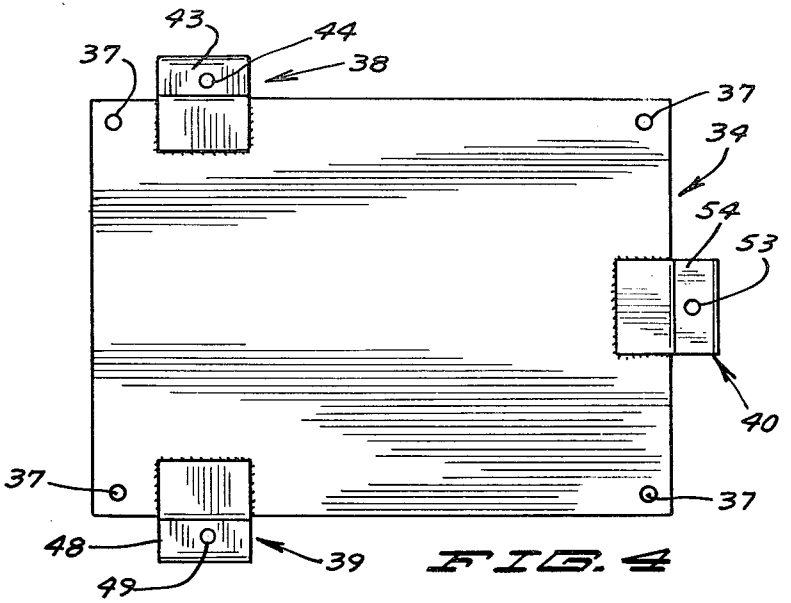
FIG. 4 is a top plan view of FIG. 3.
Figure 5:
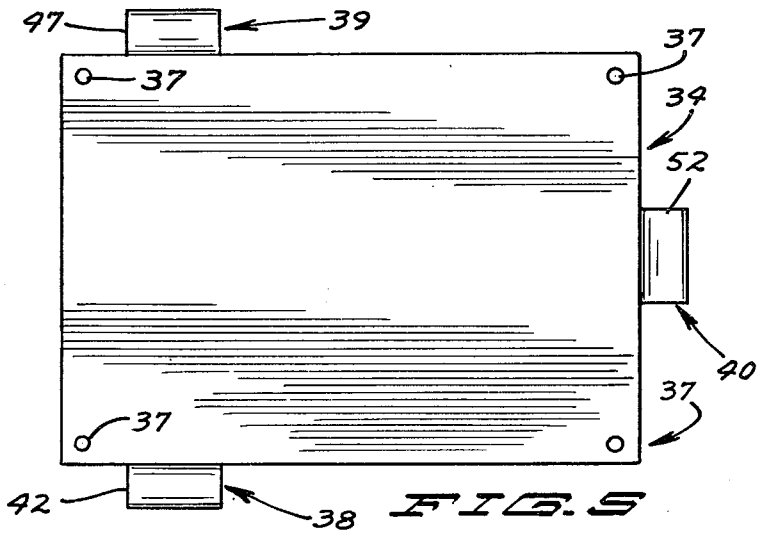
FIG. 5 is a bottom plan view of FIG. 3.

Referring to FIGS. 1 and 2, there is shown a housing indicated generally at 10 having upright walls 11 and a floor 12 surrounding a compartment or chamber 13. Housing 10 can be a box-like structure, such as the battery compartment on a vehicle. The vehicle can be a motor vehicle, bus, motor home, travel trailer or the like. Housing 10 can be part of a water vehicle or boat structure or a commercial or residential dwelling. An air compressor indicated generally at 14 is located in compartment 13. Operation of compressor 14 produces audible noises and vibrations which must be controlled or dampened.

A tank 16 is located in compartment 13 adjacent compressor 14 for receiving and storing the air under pressure. A flexible hose 17 of rubber or synthetic material is connected to compressor 14 and the tank 16 for carrying the air from the compressor to the tank. A coupling 18 secured to the end of tank 16 carries the outlet end of hose 17. An outlet line or pipe 19 is connected with a coupling 21 to the end of tank 16 for carrying the air under pressure to desired locations such as the brake and door controls of the vehicle. A support 22, shown as a strap, surrounds tank 16 and is secured to the side wall 11 with fasteners 23 such as nut and bolt assemblies. Other types of support structure can be used to hold the tank 16 in chamber 13, either on wall 11 or the floor 12.

Air compressor 14 has a casing or housing indicated generally at 24 surrounding the compressor 26 and motor 27. Compressor 26 has a head 28 containing an outlet coupling 29. The compressor 14 has a reciprocating piston 15 moving in a chamber open to the coupling 29. Suitable valves (not shown) operate to control the flow of air through an inlet opening and through the outlet coupling 29 in response to the reciprocating movement of the piston. Motor 24, such as an internal combustion engine or electric motor, functions to drive the reciprocating piston through a conventional crank shaft arrangement. The compressor 14 is a conventional structure.

The flexible hose 17 is connected to the outlet coupling 29 and secured thereto with a band clamp 31. A similar band clamp 32 surrounds the outlet end of hose 17 to clamp the hose on the tank coupling 18. Hose 17, being of flexible material, does not transmit the vibrations of the compressor to the tank 16 and dampens the pulsating vibrations of the air moving through the hose.

The air compressor 14 is carried on a mount assembly indicated generally at 33. Mount assembly 33 functions to isolate the vibrations of the air compressor from housing 10, particularly the floor 12. When the air compressor 14 is mounted directly on floor 12, the floor functions as a sounding board which increases the noise output of the compressor as well as transmits the vibrations of the compressor directly to the housing 10. Mount assembly 33 can be used to resiliently support equipment and machines other than air compressors.

Figure 3:
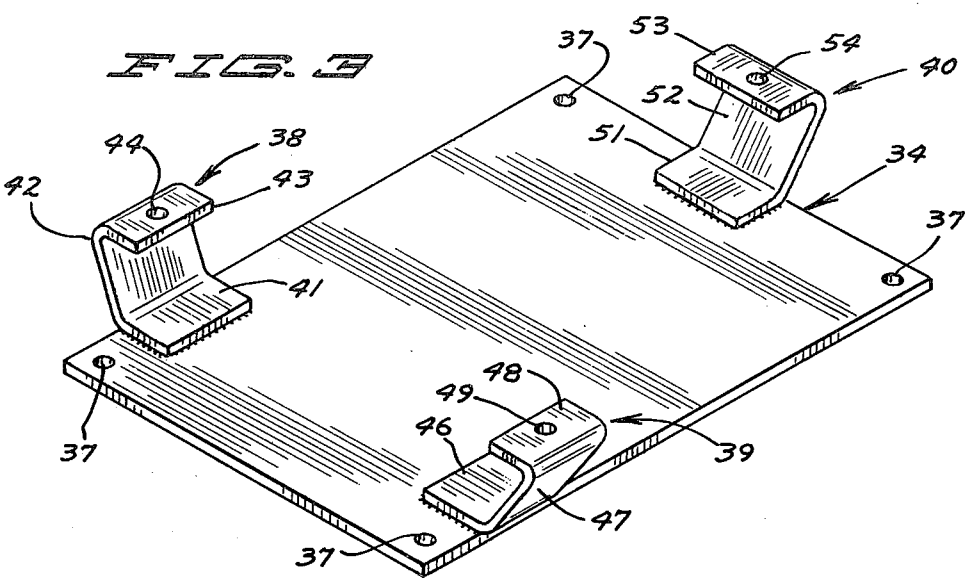
FIG. 3 is a perspective view of the mount plate assembly of FIGS. 1 and 2.
Figure 6:
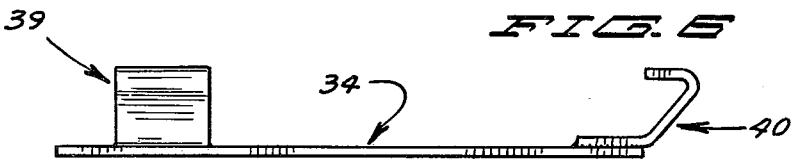
FIG. 6 is a side elevational view of the right side of FIG. 3.
Figure 7:
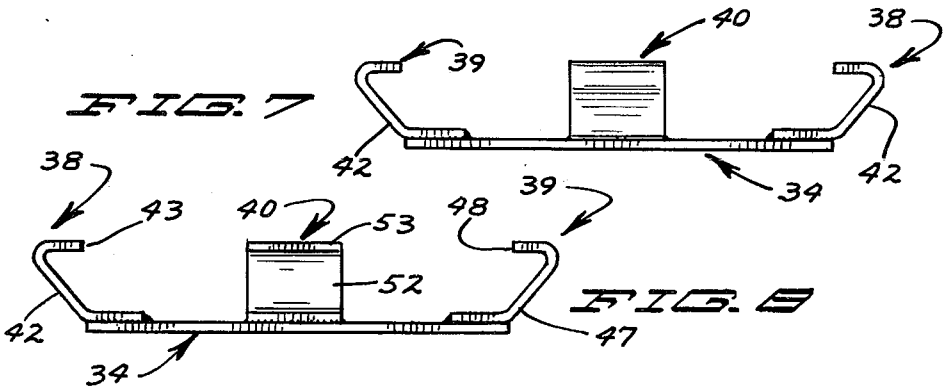
FIG. 7 is an end elevational view of the right end of FIG. 3.

Mount assembly 33 has a flat rectangular base plate 34. Base plate 34 is secured to the top of floor 12 with a plurality of nut and bolt assemblies or similar fasteners 36. Referring to FIG. 3, plate 34 has four holes 37, with one hole in each corner of the plate, to accommodate fasteners 36.

A plurality of upwardly directed arms 38, 39 and 40 are secured to separate portions of plate 34. As shown in FIG. 3, arms 38 and 39 are secured to the opposite sides of the plate adjacent one end of the plate. The arms 38 and 39 face each other and are transversely aligned with each other. The arm 40 is secured to the midportion of the opposite end of plate 34. Arms 38, 39 and 40 are located in triangular relationship in that they locate the corners of a triangle.

Arm 38 has an inwardly directed horizontal bottom section 41 secured to the top of plate 34 by welds or the like. Extended upwardly and outwardly from the outer edge of section 41 is a body section 42. An inwardly directed finger section 43 is integral with the top of body section 42. Finger section 43 a hole 44.

Arm 39 has a bottom section 46 secured to the top of plate 34 by welds or the like. An upwardly and outwardly directed body section 47 is integral with bottom section 46 and terminates in an inwardly directed finger section 48. Finger section 48 is directed toward the finger section 44. Finger section 48 has a hole 49.

Arm 40 has a bottom or base section 51 secured to plate 34 and joined to an upwardly and outwardly directed body section 52. An inwardly directed finger section 53 is joined to the top of body section 52. Finger section 53 has a hole 54. The finger section 53 extends in the longitudinal direction of plate 34 and is generally normal to the transverse extension of finger sections 43 and 48. As shown in FIG. 8, finger sections 43, 48 and 53 are located in the same horizontal plane.

Returning to FIGS. 1 and 2, a holder indicated generally at 56 is mounted on the casing 24. Holder 56 has a first arcuate part 57 and a second arcuate part 58. Parts 57 and 58 are joined with a hinge 59. The adjacent ends of parts 57 and 58 have outwardly directed flanges accommodating a fastener, such as nut and bolt assembly 61, used to clamp the parts 57 and 58 about casing 24. A strap member 62 is secured to the bottom portion of part 57. Other holder structure can be used to attach member 62 to the compressor 24. Strap member 62 has outwardly directed opposite ends 62A and 62B generally aligned with the finger sections 43 and 48. A first tension coil spring 63 is connected to finger section 43 and the end 62A. Spring 63 has end portions that extend through the hole 44 in finger section 43 and the hole in end 62A. A second tension coil spring 64 is connected to finger section 48 and the end section 62B. The spring 64 has an end hook that extends through hole 49 in finger section 48 and a second end hook that extends through the hole in end 62B.

A third tension coil spring 68 resiliently connects finger section 53 with casing 24. A bar 66 having a hole is secured to casing 24 with a bolt 67. Other means, such as welds, can be used to secure bar 66 to casing 24. Alternatively, casing 24 can have a flange with a hole to accommodate spring 68.

The springs 63, 64 and 68 are tension coil springs which resiliently mount air compressor 24 on the arms 38, 39 and 40. Arms 38, 39 and 40, being of flat and yieldable material, also function as flat or leaf springs to yieldably support air compressor 24 above the plate 34. The springs 63, 64 and 68 dampen the vibrations of the air compressor and isolate the vibrating air compressor from floor 12. The yielding tension coil springs 63, 64 and 68 in conjunction with the resilient arms 38, 39 and 40 form a resilient suspension system for the air compressor 14 that dampens and abates noise and vibrations caused by the operating air compressor. The springs 63, 64 and 68 have greater resiliency than the arms 38, 39 and 40. The differences between the resilient characteristics of the springs 63, 64 and 68 and the arms 38, 39 and 40 have an additional vibration dampening effect on the resilient suspension system for the air compressor 14.

While there has been shown and described a preferred embodiment of the invention, it is understood that the invention can be present in other embodiments and that changes in parts, materials, springs and size of parts can be made without departing from the invention. The invention is defined in the following claims.

The embodiments of the invention in which an exclusive property or privilege is claimed are defined as follows:

1. An air compressor and mount assembly comprising compressor means having a moving piston to compress air, motor means for moving the piston and a housing for the compressor means and motor means, a mount assembly for supporting the compressor means and motor means, said mount assembly having a base plate adapted to be secured to a fixed support, a plurality of upwardly directed arms secured to the base plate, a holder having a first part and a second part said parts surrounding the housing and releasably clamped on the housing, a strap member secured to one of the parts, said strap member having ends aligned with two of the arms, and a pair of first coil tension springs, each said first spring attached to one of said arms and one of the ends of the strap member, and a second coil tension spring attached to third arm and means mounted on the housing, to resiliently support the compressor means and motor means on the base plate.

2. The structure of claim 1 wherein: the base plate has sides and an end, said arms comprising a first arm secured to one side of the base plate, a second arm secured to the other side of the base plate, and a third arm secured to the end of the base plate.

3. The structure of claim 2 wherein: the first, second and third arms are arranged in a triangular pattern.

4. The structure of claim 2 wherein: each arm has an upwardly directed back section and an inwardly directed finger section, said springs being attached to the finger sections.

5. The structure of claim 4 wherein: each arm is a flexible member, said springs having greater flexing characteristics than the members of the arms.

6. The structure of claim 1 wherein: each arm has a flexible member.

7. The structure of claim 1 wherein: the arms comprise a pair of transversely aligned arms and an arm located along a line that bisects the transverse plane of the pair of arms.

8. The structure of claim 7 wherein: each arm has an inwardly directed finger section on the upper end of the arm, said springs being attached to the finger sections.

9. The structure of claim 1 wherein: the first part and second part are arcuate members, hinge means connecting adjacent first ends of the arcuate members, and clamp means connecting adjacent second ends of the arcuate members to releasably attach the arcuate members to the housing.

10. A mount assembly and equipment resiliently supported on the mount assembly comprising: equipment having a housing and means operable to vibrate the equipment, a base plate adapted to be attached to a fixed support, a plurality of arms secured to and projected away from the base plate, and coil tension spring means connected to the arms and housing to resiliently support the equipment, and holder means having parts surrounding the housing, means releasably attaching the parts to the housing, and a strap member attached to one part and having opposite ends, said spring means including a pair of springs connected to the ends of the strap member and a pair of arms.

11. The structure of claim 10 wherein: the base plate has sides and an end, said arms comprising a first arm secured to one side of the base plate, a second arm secured to the other side of the base plate, and a third arm secured to the end of the base plate.

12. The structure of claim 11 wherein: the first, second and third arms are arranged in a triangular pattern.

13. The structure of claim 11 wherein: each arm has an upwardly directed back section and an inwardly directed finger section, said spring means being attached to the finger sections.

14. The structure of claim 13 wherein: each arm is a flexible member, said spring means having greater flexing characteristics than the members of the arms.

15. The structure of claim 10 wherein: each arm has a flexible member.

16. The structure of claim 10 wherein: the arms comprise a pair of transversely aligned arms and an arm located along a line that bisects the transverse plane of the pair of arms.

17. The structure of claim 16 wherein: each arm has an inwardly directed finger section on the upper end of the arm, said spring means being attached to the finger section.

18. The structure of claim 10 wherein: said arm means includes a pair of arms aligned with and located outwardly of the ends of the strap member, said pair of arms having inwardly directed fingers on the outer ends of the arms, said pair of springs being connected to said fingers.

19. The structure of claim 10 wherein: said parts of the holder means comprise a first arcuate member, a second arcuate member, hinge means connecting adjacent first ends of the arcuate members, and clamp means connecting adjacent second ends of the arcuate members to releasably attach the holder means on the housing.

* * * * *